United States Patent [19]

Fink, IV

[11] 4,416,284

[45] Nov. 22, 1983

[54] TWO PIECE BRASSIERE AND METHOD OF USE

[76] Inventor: Stanton F. Fink, IV, 324 Codifer Blvd., Apt. 4, Metairie, La. 70005

[21] Appl. No.: 183,476

[22] Filed: Sep. 2, 1980

[51] Int. Cl.[3] ..... A41C 3/00

[52] U.S. Cl. ..... 128/425; 128/510

[58] Field of Search ..... 128/510, 425, 509

[56] References Cited

U.S. PATENT DOCUMENTS 3,465,756 9/1969 Lockwood et al. ..... 128/510

FOREIGN PATENT DOCUMENTS 197808 9/1978 Fed. Rep. of Germany ..... 128/510

*Primary Examiner*—Doris L. Troutman

*Attorney, Agent, or Firm*—James B. Lake, Jr.

[57] ABSTRACT

A two-piece brassiere comprises separate breast cups, each having individual supporting straps. Each cup is independently fitted to a respective breast in size and shape, the cups being made in a variety of sizes and shapes for use in single pieces in any combination. The cups are approximately three-cornered and uniform for use with both breasts. Supporting straps are attached to each of three cup corners, two straps being adapted to pass horizontally around the chest of a wearer and the third strap being adapted to extend upward over an adjacent shoulder. The horizontal straps of each piece of the brassiere fasten together. The upwardly extending strap of each piece fastens in back to the horizontal straps of its piece to support associated breasts in their natural angular divergence of the associated breast.

2 Claims, 7 Drawing Figures

TWO PIECE BRASSIERE AND METHOD OF USE

BACKGROUND OF THE INVENTION

The invention relates generally to womens' brassieres, and more particularly to a two piece brassiere in which the pieces are combined in sizes and shapes for each piece to fit and support an associated breast independently of the other and in respectively natural positions.

The prior art teaches single cup brassiere for a breast remaining after a masectomy, as in U.S. Pat. No. 3,094,125 to Lewis, and one in combination with a false breast to take the place of the lost breast, as in U.S. Pat. No. 1,417,930 to Mailleue. Single quarter cups are provided by Mellinger, U.S. Pat. No. 3,934,593, for individually pasting to the respective lower part of each breast.

The closest prior art is a sling brassiere, with no front connections between cups, for wear with low-cut gowns as in Lockwood et al, U.S. Pat. No. 3,465,754.

The remaining prior art teaches brassieres fabricated as single garments for the support of a pair of breasts in which both are identically sized, shaped and positioned. As this rarely happens, breasts are improperly supported in unnatural positions relative to each other and as attached to a torso.

Whereas the invention teaches the individual fitting of a cup to each breast in the size and shape of that particular breast, and the independent securing of each cup in support of the associated breast.

SUMMARY OF THE INVENTION

It is an object of the invention to provide a two piece brassiere for the individual fitting and support of each breast in whatever variety of sizes and shapes and positioning they happen to have been paired.

Another object of the invention is to provide a two piece brassiere that independently supports breasts in the natural position of each.

DETAILED DESCRIPTION OF THE PREFERRED EMBODIMENT

Figure 1:
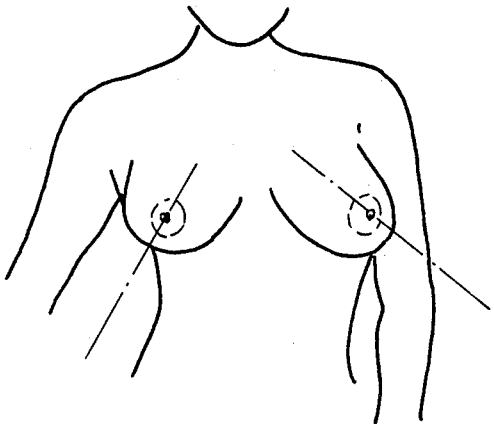
FIG. 1 is a front view of the torso of a women showing normal positions of breasts relative to each other.
Figure 2:
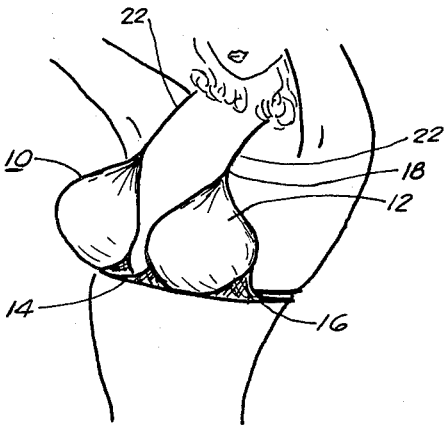
FIG. 2 is a three-quarter front view of the invention in operable assembly, and in support of both breasts.
Figure 3:
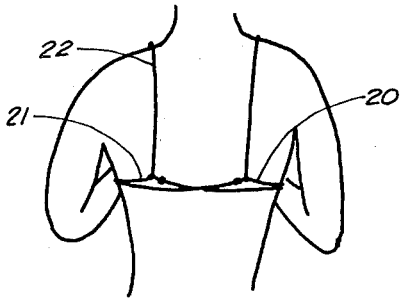
FIG. 3 is a rear view of the content of FIG. 2
Figure 4:
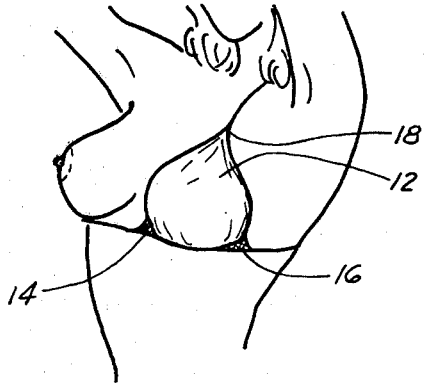
FIG. 4 is a three-quarter front view of a piece of the invention supporting the left breast.
Figure 5:
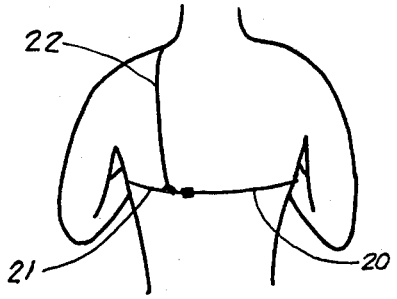
FIG. 5 is a rear view of the content of FIG. 4.
Figure 6:
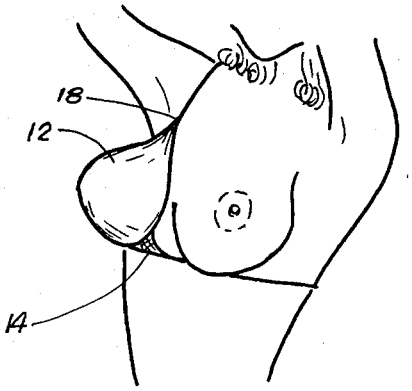
FIG. 6 is a three-quarter front view of a second piece of the invention supporting the right breast.
Figure 7:
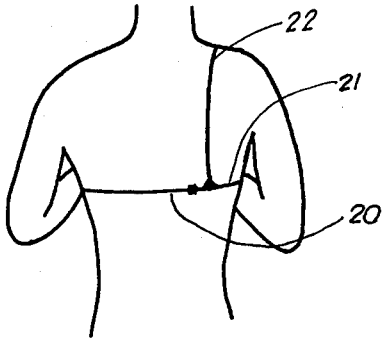
FIG. 7 is a rear view of the content of FIG. 6.

Referring to FIGS. 1–7, the invention comprises a two piece brassiere 10, having individually sized and shaped cups 12 and adapted to fit practically all breasts. Each cup 12 of brassiere 10 is approximately triangular in over-all shape with three corners 14, 16, and 18 to which securing straps 20, 21, and 22 are attached by respective ends. As brassiere 10 is worn, corners 14 and 16 are in approximate horizontal line, with straps 20 and 21 fixed in extension thereof on each cup 12 to pass oppositely around the torso 24. The respective free ends of each cup 12 straps 20 and 21 pass around torso 24 with the free ends fastening together. Strap 22 of each cup 12 is fastened to a corner 18 and extends upwardly over an adjacent shoulder and down the back for the free end to fasten with its respective cups' straps 20 and 21 in the rear. The breasts are thus independently supported in their natural outwardly diverging positions, respectively.

In the individual fitting of the independent cups 12 to associated breasts, it should be noted that the centerlines of the respective breasts naturally diverge outwardly by angle of 35 to 45 degrees or more, depending on the individual physical characteristics. Conventional one piece brassiers tend to unnaturally displace each breast inwardly by half of the angle of divergence, that is by 17 to 22 degrees, and to restrict individual breasts movement. Also the conventional brassiere has uniformly sized and shaped cups to fit a pair of breasts that seldon are uniformly sized and shaped. These deficiencies are remedied by the invention in which two pieces can be combined in use in any combination of sizes and shapes to precisely fit each of a pair of breasts and to provide natural support in respective natural positions for long periods without discomfort.

What is claimed is:

1. A two piece brassierre comprising:

(a) a plurality of three cornered breast cup means of various sizes and shapes for individually fitting each of a pair of breasts, that may be dissimilar in size and shape, with equally well-fitted breast-cup means in which two adjacent corners of each of said cup means are horizontally aligned below respective breasts and a third corner thereabove; and (b) a plurality of strap means, one fitted to each corner of each of said breast cup means, two of said strap means extending oppositely in horizontally alignment for extending around the lower chest just below said breasts, and the third of said strap means extending upwardly over the adjacent shoulder, said strap means of each said cup means being secured to the others by the free ends thereof, and independently of the strap means of the other breast cup means, for independently supporting each breast in its natural position, shape and size.

2. A method of using a two piece brassiere comprising the following steps:

(a) individually fitting each of a pair of breasts from a plurality of variously shaped and sized three-cornered breast cups, two of said corners being in horizontal alignment below a respectively associated breast and the third of said corners being thereabove; and (b) securing said individually fitted breast cups over associated breasts with straps fited by a respective end of each to a corner and the free ends of said straps fastened together horizontally around the torso of wearer just below said breast and upwardly over the adjacent shoulder and downwardly over the back to respectively fasten to said horizontal straps of the respective breast cups.

* * * * *